United States Patent [19]

Greenwood et al.

[11] Patent Number: 4,568,451

[45] Date of Patent: Feb. 4, 1986

[54] PROCESS FOR PRODUCING A HYDROGEN-RICH GAS STREAM FROM THE EFFLUENT OF A CATALYTIC HYDROCARBON CONVERSION REACTION ZONE

[75] Inventors: Arthur R. Greenwood, Niles, Ill.; Raymond Maslin, London, England

[73] Assignee: UOP Inc., Des Plaines, Ill.

[21] Appl. No.: 658,092

[22] Filed: Oct. 5, 1984

Related U.S. Application Data

[63] Continuation-in-part of Ser. No. 522,421, Aug. 11, 1983, abandoned.

[51] Int. Cl.[4] ..... C10G 25/06; C10G 35/04

[52] U.S. Cl. ..... 208/340; 208/100; 208/133; 208/134

[58] Field of Search ..... 208/340, 100, 133, 134

[56] References Cited

U.S. PATENT DOCUMENTS

| | | | |
|---|---|---|---|
| 2,405,660 | 8/1946 | Linn | 208/134 |
| 2,916,435 | 12/1959 | Tyson | 208/133 |
| 3,431,195 | 3/1969 | Storch et al. | 208/101 |
| 3,516,924 | 6/1970 | Forbes | 208/65 |
| 3,520,799 | 7/1970 | Forbes | 208/101 |
| 3,520,800 | 7/1970 | Forbes | 208/101 |
| 3,882,014 | 5/1975 | Monday et al. | 208/134 |
| 4,058,452 | 11/1977 | Loboda | 208/134 |
| 4,212,726 | 7/1980 | Mayes | 208/101 |
| 4,333,817 | 6/1982 | O'Brien | 208/134 |
| 4,333,818 | 6/1982 | Coste | 208/134 |
| 4,364,820 | 12/1982 | DeGraff et al. | 208/101 |
| 4,374,726 | 2/1983 | Schmelzer et al. | 208/101 |

FOREIGN PATENT DOCUMENTS

| | | | |
|---|---|---|---|
| 0918093 | 1/1973 | Canada | 208/134 |

OTHER PUBLICATIONS

Oil & Gas Journal, 11-10-80, pp. 191-197, "Catalytic LPG Dehydrogenation Fits in '80's Outlook" by R. C. Berg, J. R. Mowry, and B. V. Vora.

*Primary Examiner*—John Doll
*Assistant Examiner*—Lance Johnson
*Attorney, Agent, or Firm*—Thomas K. McBride; William H. Page, II

[57] ABSTRACT

A process for providing a hydrogen-rich gas stream from a reaction zone effluent comprising hydrogen and hydrocarbons is disclosed.

9 Claims, 1 Drawing Figure

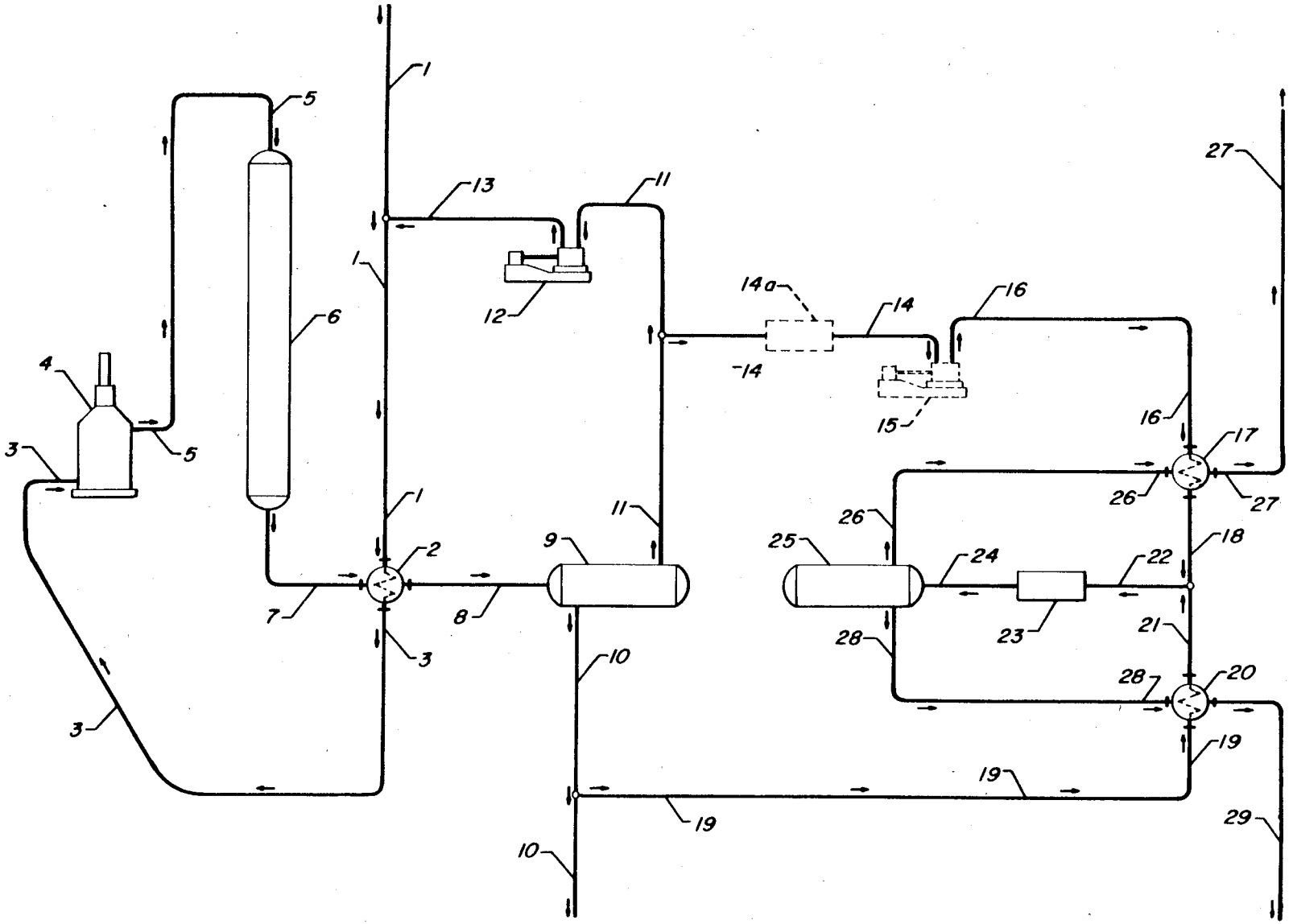
1
2
3
4
5
6
7
8
9
10
11
12
13
14
14a
15
16
17
18
19
20
21
22
23
24
25
26
27
28
29

PROCESS FOR PRODUCING A HYDROGEN-RICH GAS STREAM FROM THE EFFLUENT OF A CATALYTIC HYDROCARBON CONVERSION REACTION ZONE

CROSS-REFERENCE TO RELATED APPLICATIONS

This application is a continuation-in-part of prior copending application, Ser. No. 522,421, filed Aug. 11, 1983, now abandoned.

BACKGROUND OF THE INVENTION

The present invention is directed toward an improved method for recovering a hydrogen-rich gas stream from a hydrogen and hydrocarbon effluent of a catalytic hydrocarbon conversion zone. More particularly, the described inventive technique is adaptable for utilization in catalytic hydrocarbon conversion reactions which result in a net production of hydrogen.

Various types of catalytic hydrocarbon conversion reaction systems have found widespread utilization throughout the petroleum and petrochemical industries for effecting the conversion of hydrocarbons to a multitudinous number of products. The reactions employed in such systems are either exothermic or endothermic, and of more importance to the present invention, often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems will be net consumers of hydrogen while other systems within the refinery or petrochemical complex may result in the net production of hydrogen. Because hydrogen is a relatively expensive item, it has become the practice within the art of hydrocarbon conversion to supply hydrogen from reaction systems which result in the net production of hydrogen to reaction systems which are net consumers of hydrogen. Occasionally, the net hydrogen being passed to the net hydrogen-consuming reaction systems must be of high purity due to the reaction conditions and/or the catalyst employed in the systems. Such a situation may require treatment of the hydrogen from the net hydrogen-producing reaction systems to remove hydrogen sulfide, light hydrocarbons, etc., from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event, the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkylaromatics and catalytic dehydrogenation of paraffins. Commonly employed net hydrogen-consuming reaction systems are hydrotreating, hydrocracking and catalytic hydrogenation. Of the above mentioned net hydrogen-producing and consuming hydrocarbon reaction systems, catalytic reforming ranks as one of the most widely employed. By virtue of its wide application and its utilization as a primary source of hydrogen for the net hydrogen-consuming reaction systems, catalytic reforming has become well known in the art of hydrocarbon conversion reaction systems. Accordingly, the following discussion of the invention will be in reference to its application to a catalytic reforming reaction system. However, the following discussion should not be considered as unduly limiting the broad scope of the invention which has wide application in many hydrocarbon conversion reaction systems. Those having ordinary skill in the art will well recognize the broad application of the present invention and the following will enable them to apply the invention in all its multitudinous embodiments.

It is well known that high quality petroleum products in the gasoline boiling range including, for example, aromatic hydrocarbons such as benzene, toluene and the xylenes, are produced by the catalytic reforming process wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for the other uses.

Because the dehydrogenation of naphthenic hydrocarbons is one of the predominant reactions of the reforming process, substantial amounts of hydrogen are generated within the catalytic reforming reaction zone. Accordingly, a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons which are valuable as feedstock for other processes. It is therefore advantageous to devise a method of purifying the hydrogen-containing vapor phase to produce a hydrogen-rich gas stream and to recover valuable components such as $C_3+$ hydrocarbons.

OBJECTS AND EMBODIMENTS

A principal object of our invention is an improved process for producing a hydrogen-rich gas stream from the effluent of a catalytic hydrocarbon conversion reaction zone. A corollary objective is to provide a catalytic reforming process from which is withdrawn a hydrogen-rich gas stream of high purity for use elsewhere in the refinery or petrochemical complex. Other objects in applying the invention specifically to catalytic reforming involve increased recovery of $C_3+$ hydrocarbons for further advantageous use. Accordingly, a broad embodiment of the present invention is directed toward a process for producing a hydrogen-rich gas stream by treating a hydrogen and hydrocarbon effluent from a catalytic hydrocarbon conversion reaction zone comprising the steps of: (a) passing at least a portion of said effluent to a first vapor-liquid equilibrium separation zone and recovering therefrom a hydrogen-containing vapor phase and a first liquid phase comprising substantially hydrocarbons; (b) subjecting at least a first portion of the hydrogen-containing vapor phase to indirect heat exchange with a hereinafter defined hydrogen-rich gas stream; (c) subjecting only a portion of the first liquid phase, comprising about 10 to 20 vol. % of the total first liquid phase, to indirect heat exchange with a hereinafter defined second liquid phase; (d) admixing the heat exchanged first portion of the hydrogen-containing vapor phase and the heat exchanged portion of the first liquid phase and subjecting the resulting admixture to refrigeration; (e) passing the refrigerated admixture to a second vapor-liquid equilibrium separation zone to produce a hydrogen-rich gas stream and a second liquid phase; (f) subjecting the hydrogen-rich gas stream to indirect heat exchange with the first portion of the hydrogen-containing vapor phase pursuant to step (b) above and subjecting the second liquid phase to indirect heat exchange with the portion of the first liquid phase pursuant to step (c) above; and, (g) recovering the heat exchanged hydrogen-rich gas stream.

In an alternative and more specific embodiment, the present invention provides a process for producing a hydrogen-rich gas stream by treating a hydrogen and hydrocarbon effluent from a catalytic reforming reaction zone comprising the steps of: (a) passing the hydrogen and hydrocarbon effluent to a first vapor-liquid equilibrium separation zone and recovering therefrom a hydrogen-containing vapor phase and an unstabilized liquid reformate; (b) recycling a first portion of the hydrogen-containing vapor phase for admixture with the catalytic reforming reaction zone charge stock; (c) subjecting a second portion of the hydrogen-containing vapor phase to indirect heat exchange with a hereinafter defined hydrogen-rich gas stream; (d) subjecting only from about 10 to 20 vol. % of the unstabilized liquid reformate to indirect heat exchange with a hereinafter defined second unstabilized liquid reformate; (e) admixing the heat exchanged portion of the hydrogen-containing vapor phase and the heat exchanged portion of the unstabilized liquid reformate and subjecting the resulting admixture to refrigeration; (f) passing the refrigerated admixture to a second vapor-liquid equilibrium separation zone to produce a hydrogen-rich gas stream and a second unstabilized liquid reformate; (g) subjecting the hydrogen-rich gas stream to indirect heat exchange with the second portion of the hydrogen-containing vapor phase pursuant to step (c) above and subjecting the second unstabilized liquid reformate to indirect heat exchange with the unstabilized liquid reformate pursuant to step (d) above; and, (h) recovering the heat exchanged hydrogen-rich gas stream.

These, as well as other objects and embodiments will become evident from the following, more detailed description of the present invention.

INFORMATION DISCLOSURE

The prior art recognizes myriad process schemes for the obtention and purification of a hydrogen-rich gas stream from the effluent of hydrocarbon conversion reaction zones. U.S. Pat. No. 3,431,195, issued Mar. 4, 1969, discloses such a scheme. The hydrogen and hydrocarbon effluent of a catalytic reforming zone is first passed to a low pressure vapor-liquid equilibrium separation zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium separation zone. Because the second zone is maintained at a higher pressure, a new vapor-liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$–$C_6$ hydrocarbons.

U.S. Pat. No. 3,516,924, issued June 23, 1970, discloses a more complex system. In this reference, the reaction zone effluent from a catalytic reforming process is first separated in a vapor-liquid equilibrium separation zone to produce a hydrogen-containing vapor phase and an unstabilized liquid hydrocarbon phase. The two phases are again recontacted and again separated in a higher pressure vapor-liquid equilibrium separation zone. A first portion of the resulting hydrogen-rich vapor phase is recycled back to the catalytic reforming zone while the remaining portion of the hydrogen-rich vapor phase is passed to an absorber column in which stabilized reformate is utilized as the sponge oil. A high purity hydrogen gas stream is recovered from the absorption zone and the sponge oil, containing light hydrocarbons is recontacted with the hydrocarbon liquid phase from the first vapor-liquid equilibrium separation zone prior to the passage thereof to the second high pressure vapor-liquid equilibrium separation zone.

U.S. Pat. No. 3,520,800, issued July 14, 1970, discloses an alternative method of obtaining a hydrogen-rich gas stream from a catalytic reforming reaction zone effluent. As in the previously discussed methods, the reforming reaction zone effluent is passed to a first vapor-liquid equilibrium separation zone from which is obtained a first hydrogen-containing vapor phase and a first unstabilized hydrocarbon liquid phase. The hydrogen-containing vapor phase is compressed and recontacted with the hydrocarbon liquid phase. Thereafter the mixture is passed to a second vapor-liquid equilibrium separation zone maintained at a higher pressure than the first vapor-liquid equilibrium separation zone. A second hydrogen-containing vapor phase of higher hydrogen purity is recovered from the second vapor-liquid equilibrium separation zone with a portion thereof being recycled back to the catalytic reforming reaction zone. The remaining amount of the resulting hydrogen-containing vapor phase is passed to a cooler wherein the temperature of the phase is reduced at least 20° F. lower than the temperature maintained in the second vapor-liquid equilibrium separation zone. After cooling, the hydrogen phase is passed to a third vapor-liquid equilibrium separation zone from which a high purity hydrogen gas stream is recovered.

U.S. Pat. No. 3,520,799, issued July 14, 1970, discloses yet another method for obtaining a high purity hydrogen gas stream from a catalytic reforming reaction zone effluent. As in all the previous schemes, the reaction zone effluent is passed to a low pressure vapor-liquid equilibrium separation zone from which is produced a hydrogen-containing vapor phase and an unstabilized liquid hydrocarbon phase. After compression, the hydrogen-containing vapor phase is recontacted with the unstabilized liquid hydrocarbon phase and the resulting mixture is passed to a high pressure vapor-liquid equilibrium separation zone. A second hydrogen-containing vapor phase is produced of higher purity than the hydrogen-containing vapor phase from the low pressure vapor-liquid equilibrium separation zone. A first portion of this higher purity hydrogen-containing vapor phase is recycled back to the catalytic reforming zone. The balance of the higher purity hydrogen-containing vapor phase is passed to an absorption zone where it is contacted with a lean sponge oil preferably comprising $C_6+$ hydrocarbons. A hydrogen-containing gas stream is removed from the absorber and after cooling, passed to a third vapor-liquid equilibrium separation zone. The sponge oil, containing constituents absorbed from the higher purity hydrogen-containing vapor phase is removed from the absorption zone and is admixed with the unstabilized liquid hydrocarbon stream from the low pressure vapor-liquid equilibrium separation zone prior to the recontacting thereof with the compressed hydrogen-containing vapor phase. A stream of high purity hydrogen gas is removed from the third vapor-liquid equilibrium separation zone.

U.S. Pat. No. 3,882,014, issued May 6, 1975, discloses another method of obtaining a high purity hydrogen stream from the reaction zone effluent of a catalytic reforming process. The catalytic reforming reaction zone effluent is first passed to a vapor-liquid equilibrium separation zone from which is recovered an unstabilized liquid hydrocarbon stream and a hydrogen-containing vapor phase. After compression, the hydrogen-containing vapor phase is passed to an absorption zone wherein it is contacted with a sponge oil comprising stabilized reformate. A high purity hydrogen gas stream is recovered from the absorption zone with one portion thereof being recycled back to the catalytic reforming reaction zone while the remainder is recovered for further use. A liquid stream is recovered from the absorption zone and admixed with the unstabilized liquid hydrocarbon stream from the vapor-liquid equilibrium separation zone. The admixture is then fractionated in a stabilizing column to produce the stabilized reformate, a first portion of which is utilized as the sponge oil in the absorption zone.

More recent, U.S. Pat. No. 4,212,726, issued July 15, 1980, discloses yet another variation of the previously described methods for recovering high purity hydrogen streams from catalytic reforming reaction zone effluents. In this reference, the reaction zone effluent from the catalytic reforming process is passed to a first vapor-liquid equilibrium separation zone from which is recovered a first unstabilized hydrocarbon stream and a first hydrogen-containing vapor stream. After compression, the hydrogen-containing vapor stream is passed to an absorption column wherein it is contacted with the first liquid hydrocarbon phase from the vapor-liquid equilibrium separation zone and stabilized reformate. A high purity hydrogen gas stream is recovered from the absorption zone with one portion being recycled back to the reaction zone and the balance being recovered for further use.

U.S. Pat. No. 4,364,820, issued Dec. 21, 1982, discloses a more complex method of recovering high purity hydrogen gas from a catalytic reforming reaction zone effluent. In this reference, the reaction zone effluent is first separated in a vapor-liquid equilibrium separation zone into a first hydrogen-containing vapor phase and a first liquid hydrocarbon phase. One portion of the first hydrogen-containing vapor phase is compressed and recycled back to the catalytic reaction zone. The balance of the hydrogen-containing vapor phase is compressed and contacted with a second liquid hydrocarbon phase recovered from a hereinafter described third vapor-liquid equilibrium separation zone. The admixture is then passed to a second vapor-liquid equilibrium separation zone from which is derived a third liquid hydrocarbon phase comprising unstabilized reformate and a second hydrogen-containing vapor phase of higher purity than the first hydrogen-containing vapor phase derived from the first vapor-liquid equilibrium separation zone. The second hydrogen-containing vapor phase is subjected to compression and then contacted with the first liquid hydrocarbon phase from the first vapor-liquid equilibrium separation zone. The resulting admixture is then passed to a third vapor-liquid equilibrium separation zone from which is derived a hydrogen gas stream of high purity and the aforementioned second liquid hydrocarbon phase.

Recent U.S. Pat. No. 4,374,726, issued Feb. 22, 1983, discloses a further method of obtaining a high purity hydrogen gas stream from the reaction zone effluent of a catalytic reforming process. In this reference, the reaction zone effluent is passed to a vapor-liquid equilibrium separation zone to produce a first hydrocarbon liquid phase and a hydrogen-containing vapor phase. A first portion of the hydrogen-containing vapor phase is compressed and recycled to the catalytic reforming reaction zone. A second portion of the hydrogen-containing vapor phase is compressed and thereafter recontacted with the first liquid hydrocarbon phase from the vapor-liquid equilibrium separation zone. The resulting admixture is then passed to a second vapor-liquid equilibrium separation zone to produce a hydrogen gas stream of high purity and a second liquid hydrocarbon phase comprising unstabilized reformate.

In addition to the above-mentioned patent literature, the technical literature within the art has also disclosed methods for separating reaction zone effluents to obtain hydrogen-containing gas streams. For example, the Nov. 10, 1980 issue of the *Oil and Gas Journal* discloses an LPG dehydrogenation process in which the entire reaction zone effluent is first dried, then subjected to indirect heat exchange with a cool hydrogen-containing gas stream. The cool hydrogen-containing gas stream is derived by passing the entire cooled reaction zone effluent to a vapor-liquid equilibrium separation zone. The hydrogen-containing gas stream is removed from the separation zone and is then expanded. Thereafter it is subjected to indirect heat exchange with the entire reaction zone effluent. After the indirect heat exchange step, a portion of the hydrogen-containing vapor phase is recycled to the reaction zone.

In brief summation, the prior art which employs various vapor-liquid equilibrium separations, expansions, recontacting steps, and/or absorption to produce high purity hydrogen streams or hydrogen-containing streams is not cognizant of the techniques herein described which employs recontacting with a definite portion of liquid, refrigeration, vapor-liquid equilibrium separation, and indirect heat exchange techniques in oder to produce a high purity hydrogen gas stream.

SUMMARY OF THE INVENTION

To reiterate briefly, the process encompassed by our inventive concept is suitable for use in hydrocarbon conversion reaction systems which may be characterized as single or multiple reaction zones in which catalyst particles are disposed as fixed beds or movable via gravity flow. Moreover, the present invention may be advantageously utilized in hydrocarbon conversion reaction systems which result in the net production or the net consumption of hydrogen. Although the following discussion is specifically directed toward catalytic reforming of naphtha boiling range fractions, there is no intent to so limit the present invention.

The art of catalytic reforming is well known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 50° to about 100° F. and an end boiling point from about 325° to about 425° F. More frequently the gasoline fraction will have an initial boiling point of about 150° to about 250° F. and an end boiling point of from about 350° to 425° F., this higher boiling fraction being commonly referred to as naphtha. The reforming process is particularly applicable to the treatment of those straight run gasolines comprising relatively large concentrations of naphthenic and substantially straight chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes all of great utility in the petrochemical industry.

Widely accepted catalysts for use in the reforming process typically comprise platinum on an alumina support. These catalysts will generally contain from about 0.05 to about 5 wt. % platinum. More recently, certain promoters or modifiers, such as cobalt, nickel, rhenium, germanium and tin, have been incorporated into the reforming catalyst to enhance its performance.

The catalytic reforming of naphtha boiling range hydrocarbons, a vapor phase operation, is effected at conversion conditions which include catalyst bed temperatures in the range of from about 700° to about 1020° F.; judicious and cautious techniques generally dictate that the catalyst temperatures not substantially exceed a level of about 1020° F. Other conditions generally include a pressure of from about 20 to about 1000 psig, a liquid hourly space velocity (defined as volumes of fresh charge stock per hour per volume of catalyst particles in the reaction zone) of from about 0.2 to about 10 $hr.^{-1}$ and a hydrogen to hydrocarbon mole ratio generally in the range of from about 0.5:1 to about 10:1. As those possessing the requisite skill in the petroleum refining art are aware, continuous regenerative reforming systems offer numerous advantages when compared to the fixed bed systems. Among these is the capability of efficient operation at comparatively lower pressures—e.g. 20 to about 200 psig—and higher liquid hourly space velocities—e.g. about 3 to about 10 $hr.^{-1}$ As a result of continuous catalyst regeneration, higher consistent inlet catalyst bed temperatures can be maintained—e.g. 950° to about 1010° F. Furthermore, there is afforded a corresponding increase in hydrogen production and hydrogen purity in the hydrogen-containing vaporous phase from the product separation facility.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally a reaction zone will comprise two to four catalyst beds in either the stacked and/or side-by-side configuration. The amount of catalyst used in each of the catalyst beds may be varied to compensate for the endothermic heat of reaction in each case. For example, in a three-catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. The reactant stream, comprising hydrogen and the hydrocarbon feed, should desirably flow serially through the reaction zones in order of increasing catalyst volume with interstage heating. The unequal catalyst distribution, increasing in the serial direction of reactant stream flow, facilitates and enhances the distribution of the reactions.

Upon removal of the hydrocarbon and hydrogen effluent from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat which would otherwise be lost for further use in the catalytic reforming process. Following any such cooling step, which may be employed, the reaction zone effluent is passed to a vapor-liquid equilibrium separation zone to recover a hydrogen-containing vapor phase from the effluent, at least a portion of which is to be recycled back to the reforming zone. The vapor-liquid equilibrium separation zone is usually maintained at substantially the same pressure as employed in the reforming reaction zone, allowing for the pressure drop in the system. The temperature within the vapor-liquid equilibrium separation zone is typically maintained at about 60° to about 120° F. The temperature and pressure are selected in order to produce a hydrogen-containing vapor phase and a principally liquid phase comprising unstabilized reformate.

As noted previously, the catalytic reforming process generally requires the presence of hydrogen within the reaction zone. Although this hydrogen may come from any suitable source, it has become the common practice to recycle a portion of the hydrogen-containing vapor phase derived from the vapor-liquid equilibrium separation zone to provide at least part of the hydrogen required to assure proper functioning of the catalytic reforming process. The balance of the hydrogen-containing vapor phase is therefore available for use elsewhere. In accordance with the present invention, at least a portion of the hydrogen-containing vapor phase, which may comprise the balance of the hydrogen-containing vapor phase not recycled to the reaction zone, is subjected to refrigeration. Although not typically necessary for catalytic reforming, it may be necessary to assure that the hydrogen-containing vapor phase is sufficiently dry prior to refrigeration. Drying of the hydrogen-containing vapor phase may be necessary because water, intentionally injected into the reaction zone or comprising a reaction zone feed contaminant, must be substantially removed to avoid formation of ice upon refrigeration. By drying the hydrogen-containing vapor phase, formation of ice and the concomitant reduction of heat transfer coefficients in the heat exchanger of the refrigeration unit utilized to effect the cooling are avoided.

If drying is required, it may be effected by any means known in the art. Absorption using liquid desiccants such as ethylene glycol, diethylene glycol, and triethylene glycol may be advantageously employed. In such an absorption system, a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica gel, silica-alumina beads, and molecular sieves are typical of the solid desiccants which may be employed. Generally, the solid desiccant will be emplaced in at least two beds in parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

As noted above, a principally liquid phase comprising unstabilized reformate is withdrawn from the first vapor-liquid equilibrium separation zone. Pursuant to the invention, a portion of this unstabilized liquid reformate comprising from about 10 to 20 vol. % of the total reformate is passed to a heat exchange means for indirect heat exchange with a hereinafter defined second unstabilized liquid reformate. After subjecting it to indirect heat exchange, the unstabilized liquid reformate is admixed with the hydrogen-containing vapor phase which has also been subjected to indirect heat exchange. The resulting admixture is then refrigerated and separated to produce the desired hydrogen-rich gas stream. It has been determined that a 10 to 20 vol. % portion of the unstabilized liquid reformate is an optimum amount for recontacting with the hydrogen-containing vapor phase to achieve the highest hydrogen purity in the hydrogen-rich gas for the minimum cost in utilities and capital. In particular, it has been determined that the molar ratio of the unstabilized liquid reformate to the hydrogen-containing vapor phase may advantageously be about 0.13 to achieve a high hydrogen purity in the hydrogen-rich gas stream while reducing refrigeration and pumping costs.

As indicated above, the hydrogen-containing vapor phase is subjected to indirect heat exchange with a hereinafter defined hydrogen-rich gas, and the 10 to 20 vol. % portion of the unstabilized liquid reformate is subjected to indirect heat exchange with a second unstabilized liquid hydrocarbon. The indirect heat exchanging steps serve to precool the hydrogen-containing vapor phase and the unstabilized liquid reformate prior to their admixture and refrigeration.

After the hydrogen-containing vapor phase and the unstabilized liquid reformate are precooled, they are admixed. As will readily be recognized by the practitioner, upon precooling, a small portion of the hydrogen-containing vapor phase may condense; however, it is to be understood that the term "hydrogen-containing vapor phase" as used herein is intended to include that small condensed portion. Hence, the entire hydrogen-containing vapor phase including any portion thereof condensed upon precooling is admixed with the unstabilized liquid reformate.

In accordance with the invention, the admixture is then subjected to refrigeration. Any suitable refrigeration means may be employed. For example, a simple cycle comprising a refrigerant evaporator, compressor, condenser, and expansion valve or if desired, a more complex cascade system may be employed. The exact nature and configuration of the refrigeration scheme is dependent on the desired temperature of the refrigerated admixture and in turn that temperature is dependent on the composition of the admixture and the desired hydrogen purity of the hydrogen-rich gas. Preferably, the temperature should be as low as possible with some margin of safety to prevent freezing. Generally, the refrigeration temperature will be from about −15° to 15° F. In addition, it should be noted that the exact desired temperature of the refrigerated admixture will determine whether drying of the hydrogen-containing vapor phase is necessary in order to avoid ice formation within the refrigeration heat exchanger and the concomitant reduction in heat transfer coefficient accompanied therewith. For catalytic reforming, a temperature of about 0° F. is usually suitable without the necessity of drying the hydrogen-containing vapor phase. This is because the water content of the hydrogen-containing vapor phase is about 20 mole ppm.

After refrigeration, the admixture is passed to a second vapor-liquid equilibrium separation zone. Because the composition, temperature, and pressure of the constituents within the second vapor-liquid equilibrium separation zone are different from those in the first vapor-liquid equilibrium separation zone, a new vapor-liquid equilibrium is established. The exact conditions within the zone will of course be dependent on the desired hydrogen purity of the hydrogen-rich gas stream withdrawn from the second vapor-liquid equilibrium separation zone. Generally, the conditions will include a temperature of from −35° to 35° F., preferably a temperature of from −15° to 15° F., and a pressure of from about 30 to 900 psig.

In accordance with the invention, a second unstabilized liquid reformate is withdrawn from the second vapor-liquid equilibrium separation zone. This second reformate will differ from the first unstabilized liquid reformate in that the second will contain more $C_1+$ material transferred from the hydrogen-containing vapor phase. The second unstabilized reformate withdrawn from the second vapor-liquid equilibrium separation zone may be passed to a fractionation zone after being subjected to indirect heat exchange in accordance with the invention. The unstabilized reformate is then fractionated to produce a stabilized reformate product as commonly practiced in the art. In particular, it should be noted that in subjecting the second unstabilized reformate to indirect heat exchange, it is thereby preheated prior to its passage to the fractionation zone. The indirect heat exchange step therefore results in supplementary energy savings by avoiding the necessity of heating the second unstabilized reformate from the temperature at which the second vapor-liquid equilibrium separation zone is maintained prior to fractionation and also by reducing the refrigeration requirement of the system.

The hydrogen-rich gas stream withdrawn from the second vapor-liquid equilibrium separation zone will preferably have, depending on the conditions therein, a hydrogen purity in excess of 90 mole %. After subjecting the hydrogen-rich gas stream to indirect heat exchange pursuant to the invention, the hydrogen-rich gas stream may then be passed to other hydrogen-consuming processes or may be utilized in any suitable fashion. It should be noted that by subjecting the hydrogen-rich gas stream to indirect heat exchange with the hydrogen-containing vapor phase, there accrues certain supplementary energy savings. Typically, the hydrogen-rich gas stream must undergo heating before it can be used in a hydrogen-consuming process. Accordingly, by subjecting the hydrogen-rich gas to indirect heat exchange and thereby warming it, energy savings will be achieved, avoiding the necessity of heating the hydrogen-rich gas stream from the temperature maintained in the second vapor-liquid equilibrium separation zone. Additionally, such a heat exchange step decreases the total refrigeration requirements further reducing the energy requirements of the system.

To more fully demonstrate the attendant advantages of the present invention, the following examples, based on thermodynamic analysis, engineering calculations, and estimates, are set forth.

BRIEF DESCRIPTION OF THE DRAWING

In further describing the present inventive concept, reference will be made to the accompanying drawing which serves to illustrate one or more embodiments thereof. Although the drawing depicts a catalytic reforming process, as previously indicated, there is no intent to so limit the present invention which has broad application to hydrocarbon conversion processes which result in the net production of hydrogen. The FIGURE in the drawing depicts a simplified schematic flow diagram of a catalytic reforming process in accordance with the present invention in which only principal pieces of equipment are shown. These are a catalytic reaction zone 6, a first vapor-liquid equilibrium separation zone, 9 and a second vapor-liquid equilibrium separation zone 25. In addition, there is depicted compressor 12 and optional compressor 15, refrigeration unit 23, and optional dryer system 14*a*. In order to set forth heating and cooling means, there is shown reaction zone charge fired heater 4, combined feed exchanger means 2 and precooling heat exchangers 17 and 20. Although not utilized in the present example, optional compressor 15 and dryer system 14*a* are depicted to demonstrate how alternative schemes may employ the invention. Details such as miscellaneous pumps, heaters, coolers, valving, startup lines, and similar hardware have been omitted as being nonessential to a clear understanding of the techniques involved. The utilization of such appurtenances, to modify the illustrated process, is well within the purview of one skilled in the art, and will not remove the resulting process beyond the scope and spirit of the appended claims.

DETAILED DESCRIPTION OF THE DRAWING

Specifically referring now to the drawing, a naphtha boiling range hydrocarbon charge stock is introduced via line 1 and mixed with a hydrogen-containing vapor phase recycled via line 13. The admixture is then passed through line 1 to combined feed exchanger means 2 wherein the hydrogen and hydrocarbon charge are subjected to indirect heat exchange with the hydrogen and hydrocarbon effluent from the catalytic reforming reaction zone. The thusly preheated hydrogen and hydrocarbon charge mixture is then withdrawn from the combined feed exchanger means 2 via line 3. It is then passed into charge heater 4 wherein the hydrogen and hydrocarbon charge stock are heated to a reaction zone temperature of about 1000° F.

After being heated in charge heater 4, the hydrogen and hydrocarbon charge stock are passed via line 5 into catalytic reforming reaction zone 6 which has emplaced therein a reforming catalyst comprising platinum on alumina. The reaction zone 6 has been depicted here as a single zone for convenience; however, as previously noted, generally the reaction zone will comprise two or more catalyst beds in series with intercatalyst bed heating either in fired heaters associated with charge heater 4 or in separate heaters. Moreover, it should be noted that the reaction zone may comprise a fixed bed reaction system or alternatively it may comprise a so-called moving bed system in which catalyst particles are movable from catalyst bed to catalyst bed via gravity flow.

Regardless of the exact configuration of reaction zone 6, the effluent therefrom comprising hydrogen and hydrocarbons is withdrawn via line 7 and passed to combined feed exchanger 2. As noted above, the hydrogen and hydrocarbon effluent from reaction zone 6 is subjected to indirect heat exchange with the hydrogen and hydrocarbon feed in line 1. As a result of this heat exchange, the temperature of the reaction zone effluent is lowered from about 940° F. to about 260° F. In addition, although not depicted in the present drawing, it has become typical practice to further reduce the temperature of the reaction zone effluent to about 100° F. or less by subjecting it to indirect heat exchange with ambient air and/or cooling water.

Regardless of the exact heat exchange configuration, the reaction zone effluent is passed via line 8 to first vapor-liquid equilibrium separation zone 9 to produce a first hydrogen-containing vapor phase comprising 90.5 mol % hydrogen and a first unstabilized liquid reformate. The hydrogen-containing vapor phase is withdrawn from vapor-liquid equilibrium separation zone 9 via line 11. In order to satisfy the hydrogen requirements of the catalytic reforming reaction zone, a first portion of the hydrogen-containing vapor phase is passed via line 11 to recycle compressor 12. The first portion of the hydrogen-containing vapor phase is then passed via line 13 for admixture with the naphtha boiling range charge stock in line 1. A second portion of the hydrogen-containing vapor phase comprising the balance thereof is diverted through line 14. Although not typically required in catalytic reforming, the second portion of the hydrogen-containing vapor phase may be subject to drying prior to compression by optional drying means 14*a*. As noted previously, any suitable drying means may be employed. The first unstabilized liquid reformate phase is withdrawn from vapor-liquid equilibrium separation zone 9 via line 10. A portion comprising about 10 vol. % of the total unstabilized liquid reformate is diverted via line 19. The balance of the unstabilized liquid reformate is continued through line 10 and passed to fractionation facilities not depicted herein.

After optional drying, if employed, the second hydrogen-containing vapor phase may be compressed in optional compressor 15. Although not necessary and not used in the present example, optional compressor 15 may be employed to advantage in the invention by allowing the establishment of a new vapor-liquid equilibrium at higher pressure in separation zone 25. After any such compression, if employed, the second hydrogen-containing vapor phase is passed via line 16 to precooling heat exchanger 17. In precooling heat exchanger 17, the second portion of the hydrogen-containing vapor phase is subjected to indirect heat exchange with a hereinafter defined hydrogen-rich gas stream. As a result of this heat exchange step, the temperature of the second portion of the hydrogen-containing vapor phase is reduced from about 100° F. to about 28° F. The thusly precooled second portion of the hydrogen-containing vapor phase is then withdrawn from precooling heat exchanger 17 via line 18. The 10 vol. % portion of the unstabilized liquid reformate is passed via line 19 to precooling heat exchanger 20. It is therein subjected to indirect heat exchange with a hereinafter defined second unstabilized liquid reformate stream. As a result of this indirect heat exchange step, the temperature of the unstabilized liquid reformate is reduced from about 100° F. to about 14° F. The thusly precooled unstabilized liquid reformate is withdrawn from precooling heat exchanger 20 via line 21 and thereafter admixed with the second portion of the hydrogen-containing vapor phase in line 18.

The resulting admixture which is at a temperature of about 29° F. is passed via line 22 to refrigeration means 23 which has been depicted as a simple box for convenience. As noted previously, the exact configuration of refrigeration means 23 may be a function of numerous variables well understood by one of ordinary skill in the art, therefore, not requiring detailed description for an understanding of the present invention. The admixture is withdrawn from refrigeration zone 23 at a temperature of 0° F. via line 24 and is thereafter passed to second vapor-liquid equilibrium separation zone 25 which is maintained at a temperature of about 0° F. and a pressure of about 160 psig. First vapor-liquid equilibrium separation zone 9 is maintained at a temperature of about 100° F. and a pressure of about 150 psig and because the second vapor-liquid equilibrium separation zone is maintained at different conditions including a different liquid to vapor molar ratio, a new vapor-liquid equilibrium is established. Accordingly, a hydrogen-rich gas stream comprising about 92.2 mol % hydrogen is withdrawn via line 26 and a second unstabilized liquid reformate containing about 17 mol % $C_5$-hydrocarbons. This should be contrasted with the first unstabilized liquid reformate which contains about 9.4 mol % $C_5$-hydrocarbons. Thus, the invention results in increased recovery of hydrocarbons from the hydrogen-containing vapor phase thereby producing a hydrogen-rich gas stream.

The hydrogen-rich gas stream withdrawn from second vapor-liquid equilibrium separation zone 25 via line 26 is passed to precooling heat exchanger 17 wherein it is subjected to indirect heat exchange with the hydrogen-containing vapor phase. The temperature of the hydrogen-rich gas stream is increased from about 0° F. to 90° F. as a result of the heat exchange step. The hydrogen-rich gas stream is then withdrawn from precooling heat exchanger 17 via line 27 and passed on for further use in other process units not herein depicted.

The second unstabilized liquid reformate withdrawn from vapor-liquid equilibrium separation zone 25 via line 28 is passed to precooling heat exchanger 20. It is therein subjected to indirect heat exchange with the first unstabilized liquid reformate from line 19. As a result of this heat exchange step, the temperature of the second unstabilized liquid reformate is increased from about 0° F. to about 73° F. The thusly warmed second unstabilized liquid reformate is then withdrawn from precooling heat exchanger 20 via line 29. It is thereafter passed to fractionation facilities not herein depicted. Because it is necessary to heat the second unstabilized liquid reformate to effect the fractionation, the warming thereof in precooling heat exchanger 20 results in additional energy savings.

To more fully appreciate the unexpected and surprising results to be achieved by means of the present invention, two further case studies were performed by means of thermodynamic analysis, engineering calculation and estimates. The case set forth above in the detailed description of the drawing is designated Case I in the following discussion.

Case II differs from Case I in that about 20 vol. % of the unstabilized reformate withdrawn from vapor-liquid equilibrium separation zone 9 is diverted through line 19 for recontacting and refrigeration pursuant to the invention.

Case III differs from Case I and II in that 100 vol. % of the unstabilized reformate stream withdrawn from first vapor-liquid equilibrium separation zone 9 is directed through line 19 for further refrigeration and recontacting.

The results of these case studies are set forth below in Table 1. The recycle hydrogen purity is the mol percent hydrogen of the hydrogen-rich vapor phase recycled to the reaction zone via line 11 of FIG. 1. It is, therefore, the hydrogen purity achieved without the benefit of recontacting and refrigeration. The off-gas hydrogen purity is the mol percent hydrogen in hydrogen-rich vapor phase withdrawn from line 27 of FIG. 1. The refrigeration duty is the duty in $10^6$ BTU per hour for refrigeration means 23.

TABLE 1

| Case | I | II | III |
|---|---|---|---|
| Recycle $H_2$ Purity, Mol % | 90.5 | 90.5 | 90.5 |
| Off-Gas $H_2$ Purity, Mol % | 92.2 | 92.6 | 93.7 |

TABLE 1-continued

| Case | I | II | III |
|---|---|---|---|
| Refrigeration Duty, MMBTU Per Hr. | 0.44 | 0.57 | 1.35 |

As can be seen from the above data, Case III (100 vol. % of unstabilized liquid reformate diverted through line 19 of FIG. 1) results in the highest hydrogen purity, 93.7%; however, Case III also results in the highest refrigeration duty, 1.35 MMBTU per hr. Accordingly, in increasing the hydrogen purity from 90.5 mol % to 93.7 mol %, 1.35 MMBTU/Hr where this works out to an average of 0.42 MMBTU/Hr per 1.0 mol % increase in hydrogen purity. By way of contrast Case I and II required only 0.26 and 0.27 MMBTU/Hr per 1.0 mol % increase in hydrogen purity. It can, therefore be seen that by limiting the amount of unstabilized reformate diverted through line 19 to from about 10 to 20 vol. % in accordance with the invention, almost as high hydrogen purity may be achieved with significantly lower refrigeration duty than by diverting 100% of the unstabilized liquid reformate.

Accordingly, it can be seen from the above that the invention results in the production of a hydrogen-rich gas stream from a hydrogen and hydrocarbon effluent of a catalytic hydrocarbon conversion reaction zone.

We claim as our invention:

1. A process for producing a hydrogen-rich gas stream by treating a hydrogen and hydrocarbon effluent from a catalytic hydrocarbon conversion reaction zone comprising the steps of:

(a) passing at least a portion of said effluent to a first vapor-liquid equilibrium separation zone and recovering therefrom a hydrogen-containing vapor phase and a first liquid phase comprising substantially hydrocarbons;

(b) subjecting at least a first portion of the hydrogen-containing vapor phase to indirect heat exchange with a hereinafter defined hydrogen-rich gas stream;

(c) subjecting only a portion of the first liquid phase, comprising about 10 to 20 vol. % of the total first liquid phase, to indirect heat exchange with a hereinafter defined second liquid phase;

(d) admixing the heat exchanged first portion of the hydrogen-containing vapor phase and the heat exchanged portion of the first liquid phase and subjecting the resulting admixture to refrigeration;

(e) passing the refrigerated admixture to a second vapor-liquid equilibrium separation zone to produce a hydrogen-rich gas stream and a second liquid phase;

(f) subjecting the hydrogen-rich gas stream to indirect heat exchange with the first portion of the hydrogen-containing vapor phase pursuant to step (b) above and subjecting the second liquid phase to indirect heat exchange with the portion of the first liquid phase pursuant to step (c) above; and, (g) recovering the heat exchanged hydrogen-rich gas stream.

2. The process of claim 1 further characterized in that the catalytic hydrocarbon conversion zone comprises a catalytic reforming reaction zone.

3. The process of claim 1 further characterized in that the first portion of the hydrogen-containing vapor phase is dried prior to subjecting it to indirect heat exchange with the hydrogen-rich gas stream.

4. The process of claim 1 further characterized in that the molar ratio of the portion of the first liquid phase subjected to indirect heat exchange pursuant to step (c) to the hydrogen-containing vapor phase is about 0.13.

5. The process of claim 1 further characterized in that the portion of the first liquid phase subjected to indirect heat exchange pursuant to step (c) comprises about 10 vol. % of the total first liquid phase.

6. A process for producing a hydrogen-rich gas stream by treating a hydrogen and hydrocarbon effluent from a catalytic reforming reaction zone comprising the steps of:

(a) passing the hydrogen and hydrocarbon effluent to a first vapor-liquid equilibrium separation zone and recovering therefrom a hydrogen-containing vapor phase and an unstabilized liquid reformate;

(b) recycling a first portion of the hydrogen-containing vapor phase for admixture with the catalytic reforming reaction zone charge stock;

(c) subjecting a second portion of the hydrogen-containing vapor phase to indirect heat exchange with a hereinafter defined hydrogen-rich gas stream;

(d) subjecting only from about 10 to 20 vol. % of the unstabilized liquid reformate to indirect heat exchange with a hereinafter defined second unstabilized liquid reformate;

(e) admixing the heat exchanged portion of the hydrogen-containing vapor phase and the heat exchanged portion of the unstabilized liquid reformate and subjecting the resulting admixture to refrigeration;

(f) passing the refrigerated admixture to a second vapor-liquid equilibrium separation zone to produce a hydrogen-rich gas stream and a second unstabilized liquid reformate;

(g) subjecting the hydrogen-rich gas stream to indirect heat exchange with the second portion of the hydrogen-containing vapor phase pursuant to step (c) above and subjecting the second unstabilized liquid reformate to indirect heat exchange with the unstabilized liquid reformate pursuant to step (d) above; and, (h) recovering the heat exchanged hydrogen-rich gas stream.

7. The process of claim 6 further characterized in that the second portion of the hydrogen-containing vapor phase is dried prior to subjecting it to indirect heat exchange with the hydrogen-rich gas stream.

8. The process of claim 6 further characterized in that the molar ratio of the unstabilized liquid reformate subjected to indirect heat exchange pursuant to step (d) to the second portion of the hydrogen-containing vapor phase is about 0.13.

9. The process of claim 6 further characterized in that the unstabilized reformate subjected to indirect heat exchange pursuant to step (d) comprises about 10 vol. % of the total first liquid phase.

* * * * *